US008052018B2

(12) United States Patent
Gallagher

(10) Patent No.: US 8,052,018 B2
(45) Date of Patent: Nov. 8, 2011

(54) GUN HOLSTER WITH ARTICULATING SPINE

(76) Inventor: Richard N. Gallagher, Phoenix, AZ (US)

( * ) Notice: Subject to any disclaimer, the term of this patent is extended or adjusted under 35 U.S.C. 154(b) by 700 days.

(21) Appl. No.: 12/154,780

(22) Filed: May 27, 2008

(65) Prior Publication Data

US 2009/0294496 A1 Dec. 3, 2009

(51) Int. Cl.
*F41C 33/02* (2006.01)

(52) U.S. Cl. ..... 224/243

(58) Field of Classification Search ..... 224/243
See application file for complete search history.

(56) References Cited

U.S. PATENT DOCUMENTS

2006/0157520 A1* 7/2006 Clifton ..... 224/243
2007/0181619 A1* 8/2007 Seyfert et al. ..... 224/196
2008/0179360 A1* 7/2008 Lowe et al. ..... 224/243

* cited by examiner

*Primary Examiner* — Justin Larson
(74) *Attorney, Agent, or Firm* — Tod R. Nissle, P.C.

(57) ABSTRACT

A holster engages the ejection port of a gun to secure the gun in the holster. The holster includes a spine with a fixed upper section, a fixed lower section, and an intermediate section bridging the upper and lower sections. The intermediate section includes a rib which can extend into the ejection port of the gun. The intermediate section is pivotally attached to the fixed upper section of the spine and pivots between a first closed operative position in which the rib extends into the ejection port of the gun and a second open operative position in which the rib is removed from the ejection port so the gun can be removed from the holster.

1 Claim, 6 Drawing Sheets

GUN HOLSTER WITH ARTICULATING SPINE

This invention pertains to holsters.

A principal object and motivation of the instant invention is to provide a holster that reduces the risk that a gun will inadvertently fall from a holster and accidentally discharge, as well as reducing the risk that a criminal suspect can remove successfully a gun from the holster of a law enforcement officer and use the gun against the officer. This general motivation has long existed in connection with holsters and has produced a variety of patented and other designs to lock removably a gun in a holster. As discussed below, the trends, problems, motivations, etc. associated with such designs did not provide any significant impetus toward the development of the invention.

This and other, further and more specific objects and advantages of the invention will be apparent from the following detailed description thereof, taken in conjunction with the drawings, in which.

Briefly, in accordance with the invention, I provide an improved holster in combination with a gun including a handle, barrel, and a detent. The holster includes a spine; a first side; and, a second side opposed to the first side. The first and second sides collectively form a pocket with a top to receive the barrel with the handle extending outside the top of the pocket; are connected together along the rear of the pocket; and, are connected to the spine. The spine includes a first section and a second section. The second section has a locking rib attached thereto and is attached to the holster. The second section is movable between a first operative position generally in alignment with the first section in which the locking rib extends into the detent to prevent the gun from being withdrawn from the holster; and, a second operative position in which the second section is moved out of alignment with the first section and the locking rib is moved free of the detent to permit the gun to be withdrawn from the holster. The second section is in the first operative position. The holster also includes a finger rest connected to the second section to manually pivotally displace with the finger of a hand, while grasping the handle of the gun with the hand, the second section from the first operative position to the second operative position to permit the gun to be withdrawn from the holster.

Figure 1:
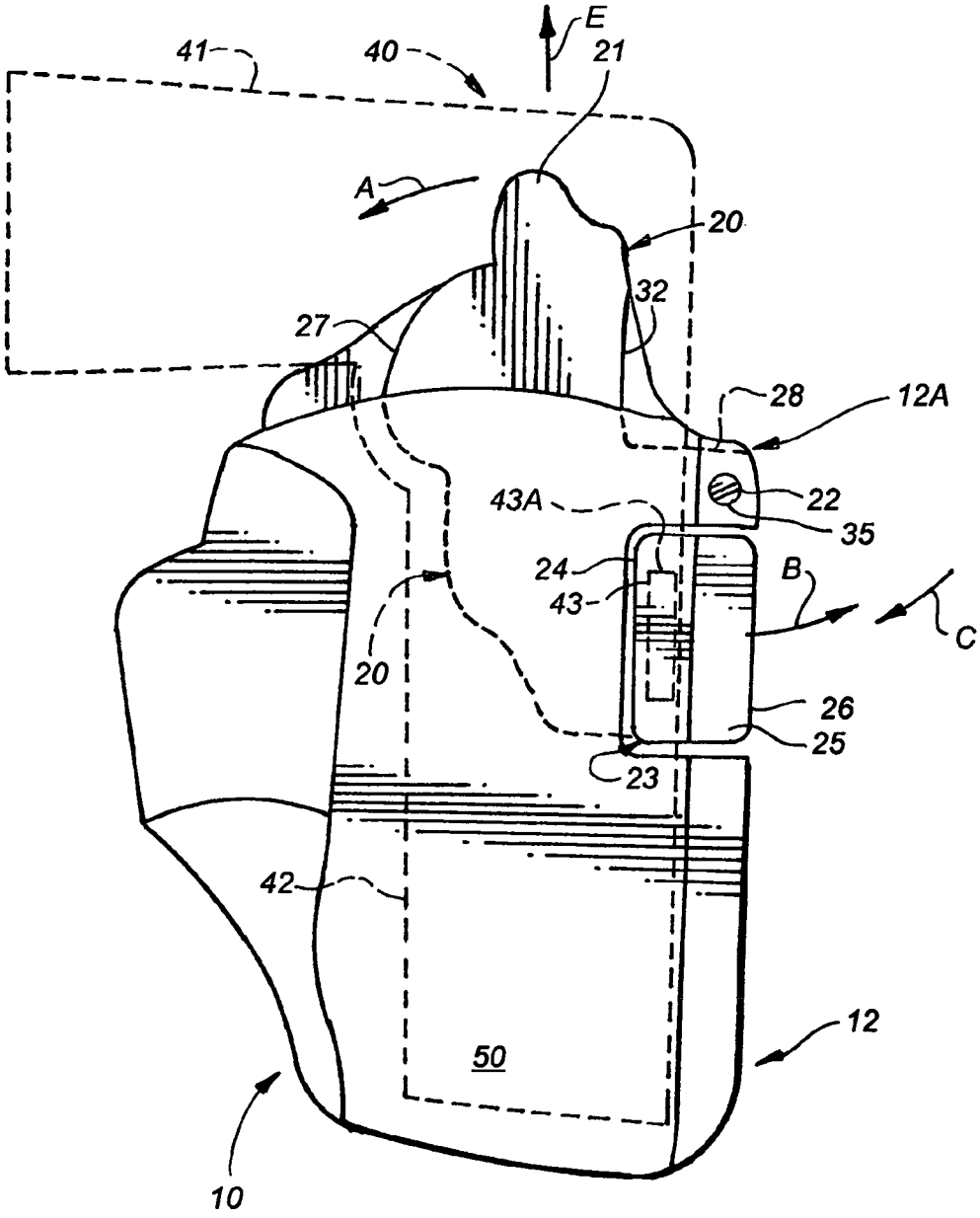
FIG. 1 is a front elevation illustrating a holster constructed in accordance with the invention.
Figure 4:
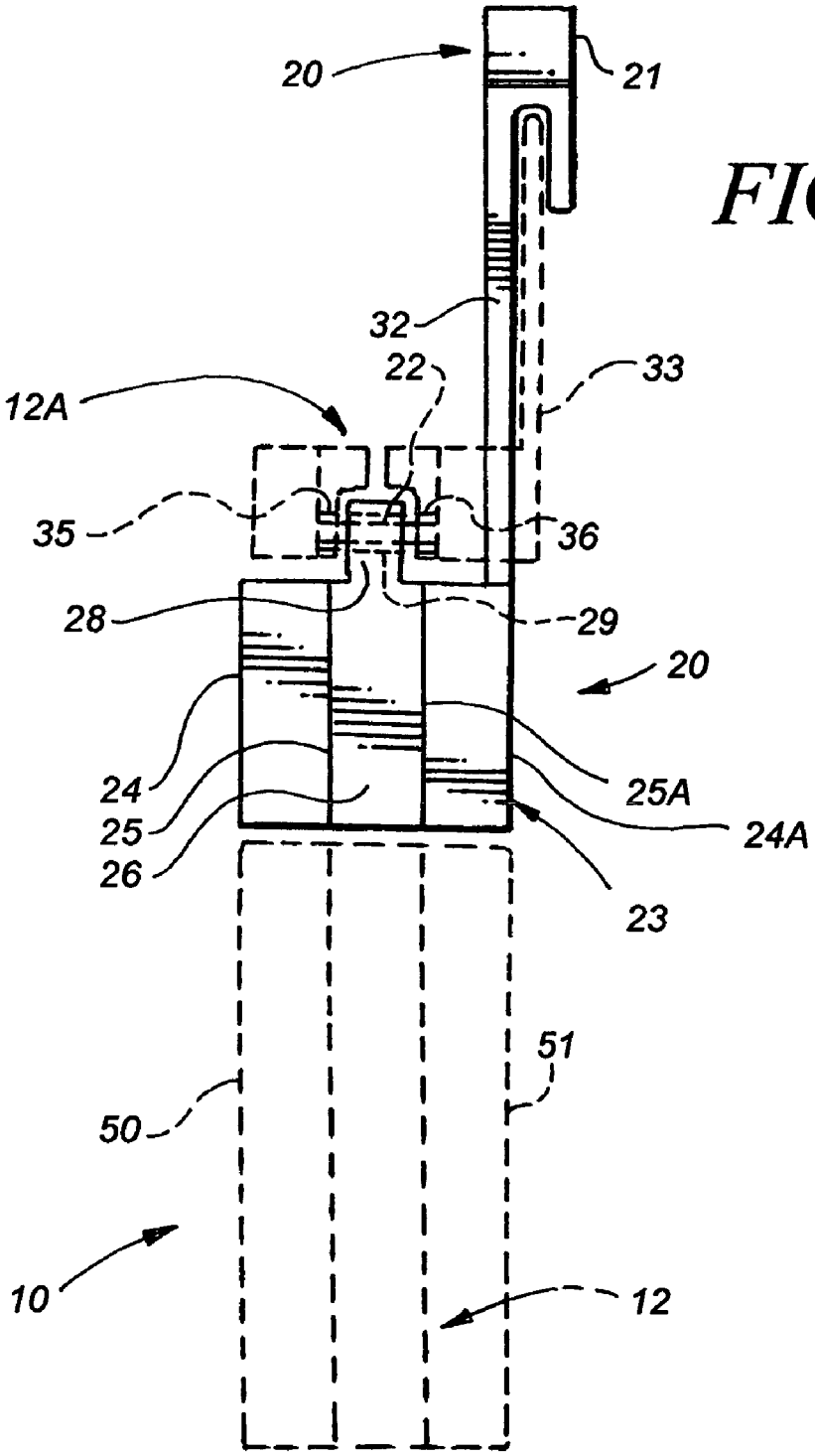
FIG. 4 is a side view illustrating the movable spin section of FIG. 2 and the mode of operation thereof.

Turning now to the drawings, which depict the presently preferred embodiments of the invention for the purpose of illustrating the practice thereof and not by way of limitation of the scope of the invention, and in which like reference characters refer to corresponding elements throughout the several views, FIGS. 1 and 4 illustrate a holster constructed in accordance with the invention and including right side 50 and left side 51 connected to a spine that includes a fixed upper section 12A, fixed lower section 12, and displaceable intermediate section 23. In FIG. 1, sections 12, 12A, and 23 are aligned with one another. Sides 50 and 51 are connected at the rear 10 of the holster and collectively form a pocket that receives the barrel 42 of a gun 40 in the manner illustrated in FIG. 1.

Figure 2:
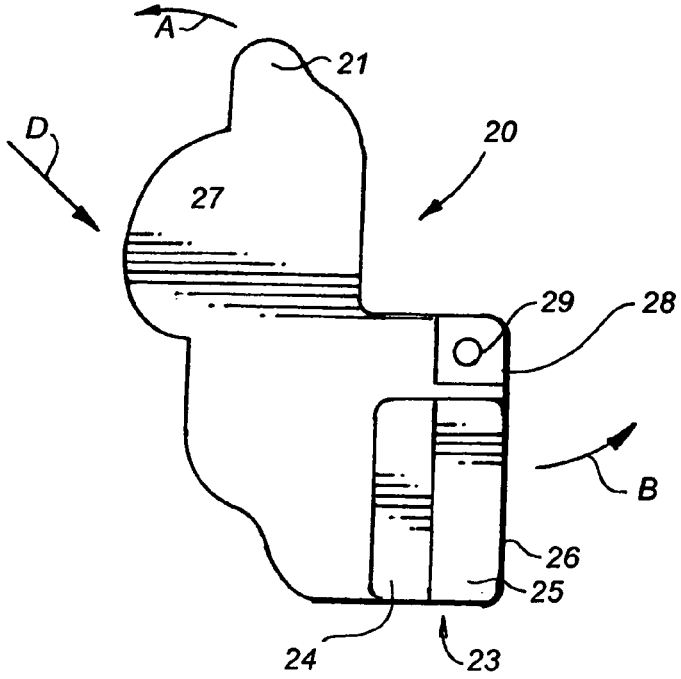
FIG. 2 is a front elevation view illustrating a movable spine section in the holster of the invention.
Figure 3:
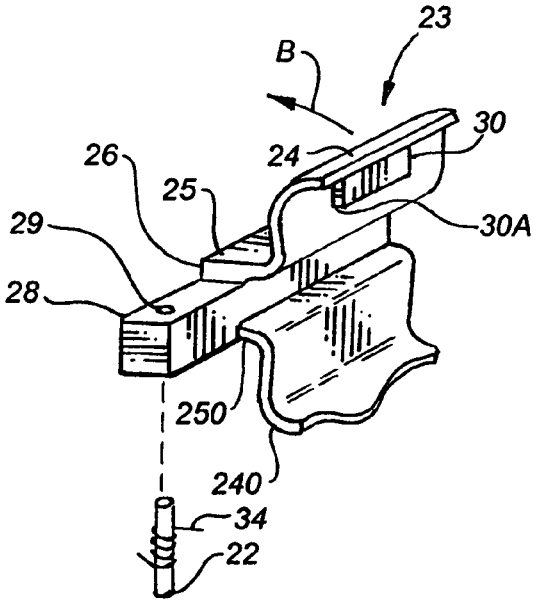
FIG. 3 is a perspective view further illustrating the movable spine section of FIG. 2.

The intermediate section 23 of the spine is shown in further detail in FIGS. 2 to 4 includes an arm 28 with an aperture 29 formed therethrough (FIG. 3). Spring loaded pin 22 extends through aperture 29. The ends of pin 22 extend outwardly from aperture 29 and into opposing, aligned, spaced apart apertures 35 and 36 (FIGS. 1 and 4) that are formed in and extend through upper section 12A of the spine or some other desired part of the holster. Arm 28 is pivotally sandwiched in upper section 12A between apertures 35 and 36 in the manner illustrated in FIG. 4.

Intermediate spine section 23 includes wings 24 and 240 connected to the upper 25 and lower 250 portions of rib 26 (FIG. 3). Arm 28 depends outwardly from rib 26.

Panel member 20 is connected to intermediate spine section 23 and includes front edge 32, rear edge 27, and U-shaped finger rest 21 located on the upper end of member 20. Finger rest 21 extends over the upper edge of the substantially rigid holster flap 33 (FIG. 4) that extends upwardly from portion 12A of the holster spine.

Figure 6:
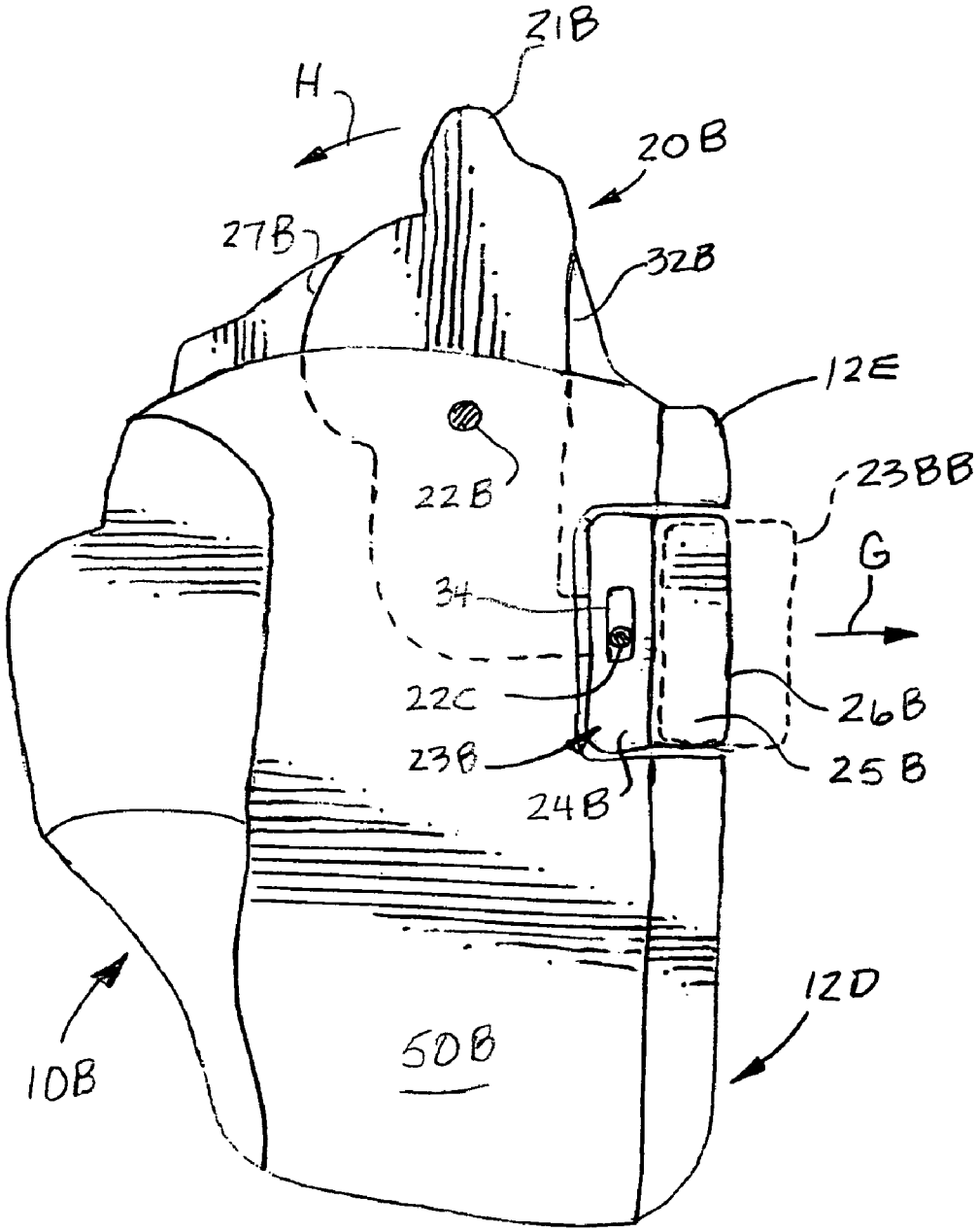
FIG. 6 is a side view illustrating a further embodiment of the invention; and, FIG. 7 is a side view illustrating still another embodiment of the invention.
Figure 7:
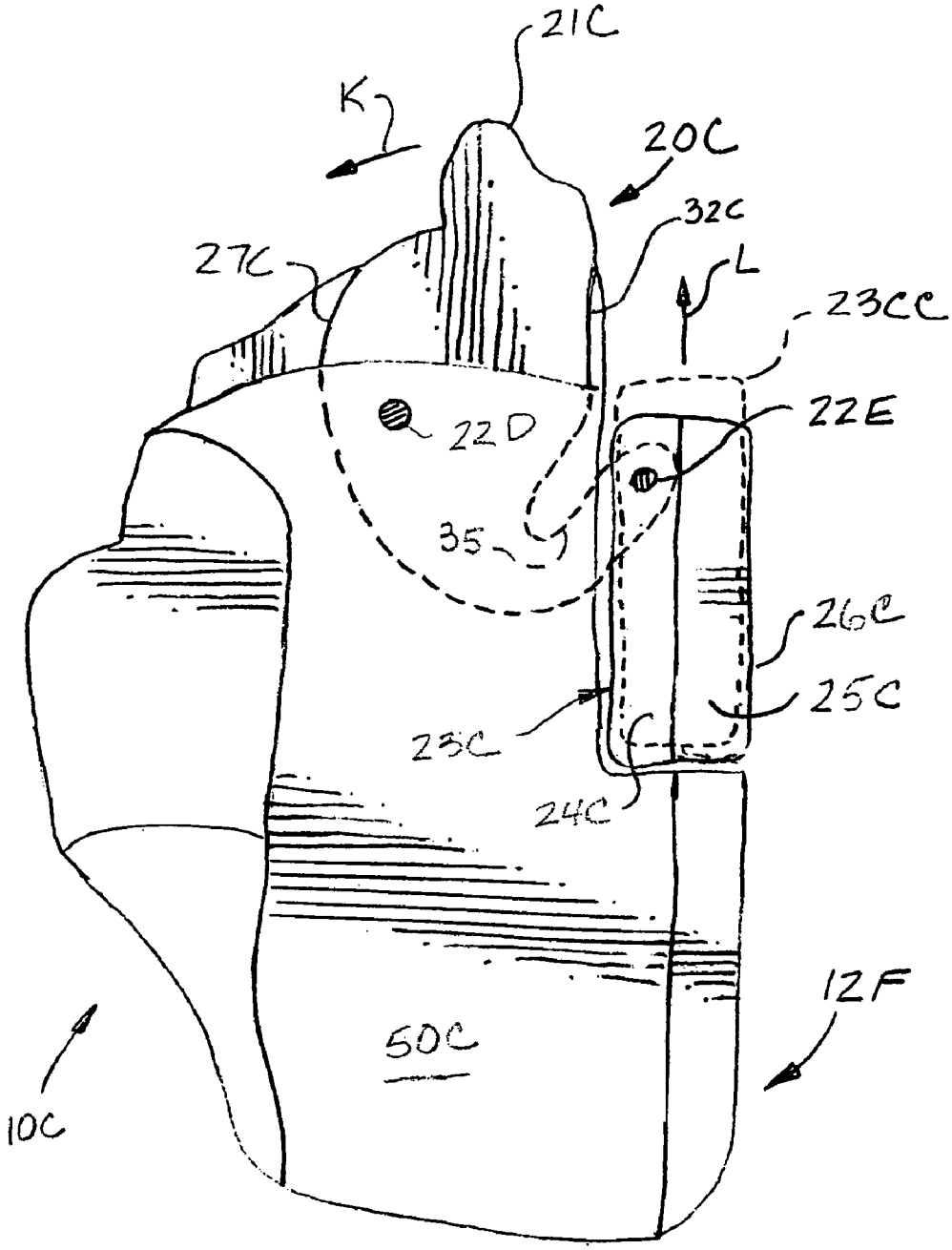

Locking rib 30 is connected to and extends outwardly from the underside of wing 24. When intermediate section 23 is in the closed position of FIG. 1, rib 30 extends into the ejection port 43 of gun 40 and prevents gun 40 from being withdrawn from the holster. Rib 30 prevents gun 40 from being withdrawn from the holster because end surface 30A of rib 30 contacts the end surface 43A of ejection port 43. Alternatively, when a user grasps the handle 41 of a gun and, with the forefinger or thumb of the hand, manually contacts and displaces finger rest 21 in the direction of arrow A, intermediate section 23 pivots about pin 22 outwardly in the direction of arrow B (FIG. 1) to disengage locking rib 30 from ejection port 43 so that gun 40 can be withdrawn from the holster. Alternate embodiments of the invention are depicted in FIGS. 5 to 7 and are discussed further on down below.

In operation, a user grasps handle 41 of gun 40 and inserts the barrel 42 into the holster to the position illustrated in FIG. 1. When barrel 42 is slid into the pocket formed by sides 50 and 51, the outer surface of the barrel contacts and displaces and causes locking rib 30 (and therefore intermediate section 23 and panel member 20) to pivot outwardly about pin 22 in the direction of arrow B. The outer surface of the barrel slides over and continues to displace rib 30 until the ejection port 43 is in alignment and registration with rib 30. When port 43 is in registration with rib 30, spring 34 (FIG. 3) causes section 23 and member 20 to pivot about pin 22 such that section 23 is displaced in the direction of arrow C and member 20 is displaced in a direction opposite that of arrow A, which causes rib 30 to seat in port 43. Once rib 30 seats in port 43, gun 40 can not be withdrawn from the holster until the user grasps handle 41, displaces finger rest 21 in the direction of arrow A to pivot outwardly member 20 and intermediate section 23 in the direction of arrow B to disengage rib 30 from port 43, and pulls gun 40 upwardly out of the holster in the direction of arrow E (FIG. 1). Once finger rest 21 is displaced in the direction of arrow A, and rib 30 is disengaged from ejection port 43, displacing gun 40 a short distance in the direction of arrow E is sufficient to release finger rest 21 and allow spring 34 to displace section 23 in the direction of arrow C so that rib 30 contacts and slides over the outer surface of barrel 42 while barrel 42 is removed from the holster. Since rib 30 is at this point only contacting the outer surface of barrel 42, and is no longer seated in ejection port 43, barrel 42 simply slides over rib 30 as gun 40 continues to be withdrawn from the holster.

As would be appreciated by those of skill in the art, panel member 20, intermediate spine section 23, and rib 30 can be shaped and dimensioned such that when a gun 40 is in a holster rib 30 engages a detent or opening other than an ejection port 43 and prevents gun 40 from being withdrawn from the holster until rib 30 is moved out of engagement with said detent or opening. For example, rib 30 if gun 40 is a colt 45 revolver, rib 30 could engage one of the detent on the exterior of the cylinder of the gun.

Figure 5:
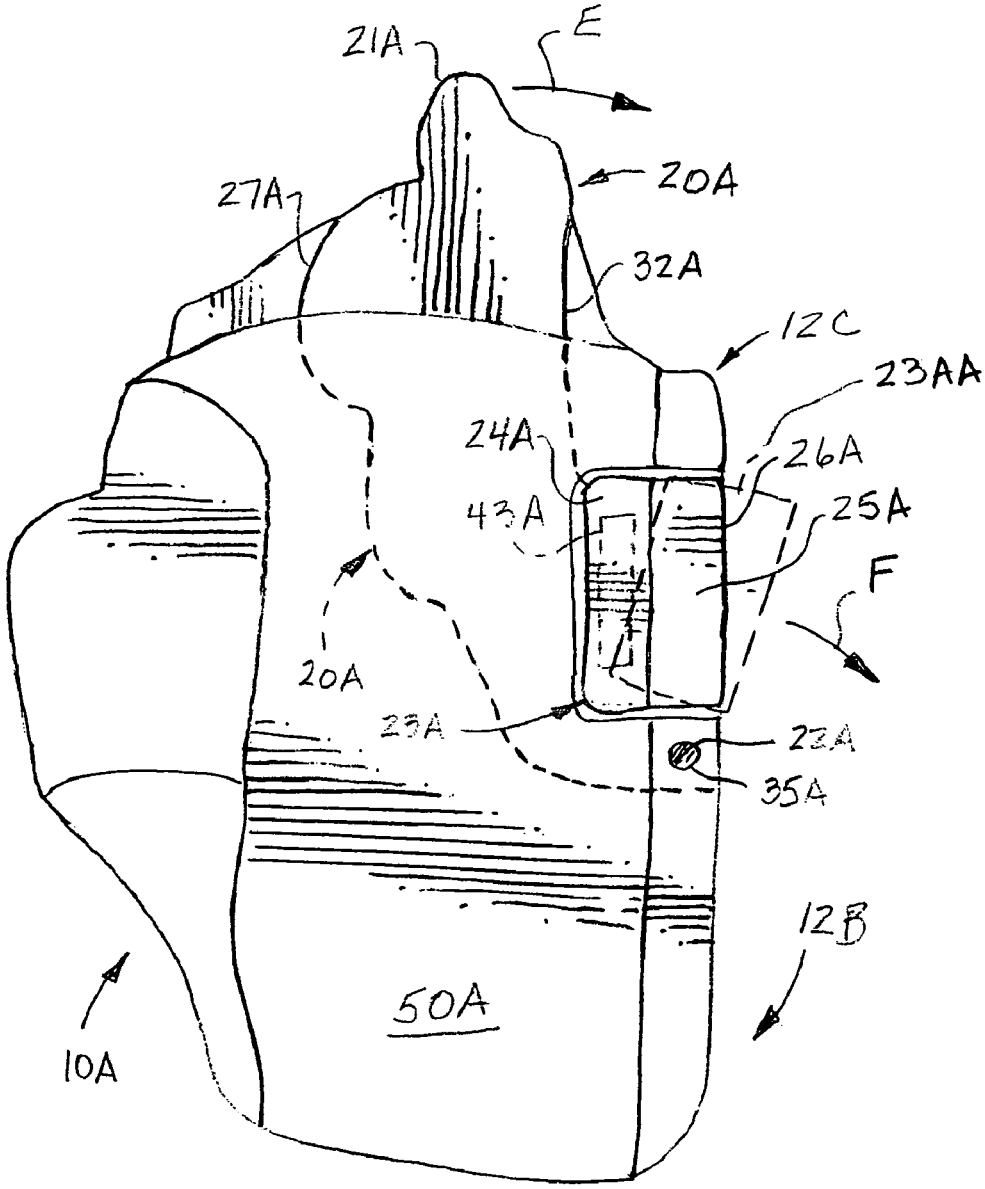
FIG. 5 is a side view illustrating another embodiment of the invention.

An alternate embodiment of the invention is illustrated in FIG. 5. Panel member 20A in FIG. 5 has a construction similar to that of panel member 20, except the pivot pin 22A for member 20A is below, instead of above, the intermediate spine section 23A. The holster in FIG. 5 includes right side 50A and left side 51A (not visible) connected to a spine that includes a fixed upper section 12C, fixed lower section 12B, and displaceable intermediate section 23A. In FIG. 5, sections 12C, 12B, and 23A are aligned with one another. Sides 50A and 51A are connected at the rear 10A of the holster and collectively form a pocket that receives the barrel of a gun (not shown) in a manner similar to that illustrated in FIG. 1.

The intermediate section 23A of the spine includes a pivot arm (similar to arm 28) with an aperture (similar to aperture 29) formed therethrough. A spring loaded pin (similar to pin 22) extends through said aperture and the of the spring loaded pin extend outwardly said aperture 29 and into opposing, aligned, spaced apart apertures that are formed in and extend through lower section 12B of the spine or some other desired part of the holster. The pivot arm is sandwiched in lower section 12B in a manner similar to that of arm 28 in FIG. 4.

Intermediate spine section 23A includes wings 24A and 240A (not visible) connected to the upper 25A and lower 250A (not visible) portions of rib 26A. The pivot arm of section 23A depends outwardly from rib 26A in a manner similar to that of arm 28 with respect to rib 26, except that the pivot arm of section 23A extends downwardly from rib 26A, while the arm 28 extends upwardly from rib 26.

Panel member 20A is connected to intermediate spine section 23A and, in a manner similar to that of panel member 20, includes front edge 32A, rear edge 27A, and U-shaped finger rest 21A located on the upper end of member 20A. Finger rest 21A extends over the upper edge of a substantially rigid holster flap that is similar to holster flap 33 (FIG. 4) that extends upwardly from portion 12C of the holster spine.

A locking rib (not visible) similar to rib 30 is connected to and extends outwardly from the underside of wing 24A. When intermediate section 23A is in the closed position illustrated in FIG. 5, the locking rib extends into the ejection port of a gun (not shown) and prevents the gun from being withdrawn from the holster. The locking rib functions in the same manner earlier described with respect to rib 30.

In operation of the embodiment of the invention illustrated in FIG. 5, a user grasps the handle of a gun and inserts the gun barrel into the holster to a position similar to that illustrated in FIG. 1. When the gun barrel is slid into the pocket formed by sides 50A and 51A, the outer surface of the barrel contacts and displaces and causes the locking rib on section 23A, causes intermediate section 23A, and causes panel member 20A to pivot outwardly about pin 22A in the direction of arrow F in the manner indicated by ghost outline 23AA in FIG. 5. The outer surface of the barrel slides over and continues to displace the locking rib until the ejection port of the gun is in alignment and registration with the locking rib. When the ejection port 43 is in registration with the locking rib (in the same manner that rib 30 and port 43 are in registration in FIG. 1), spring loaded pin 22A causes section 23A and member 20A to pivot about pin 22A such that section 23A is displaced in a direction opposite that of arrow F and member 20A is simultaneously displaced in a direction opposite that of arrow E, which causes the locking rib to seat in the ejection port. Once the locking rib seats in the ejection port, the gun can not be withdrawn from the holster until the user grasps the handle for the gun, displaces finger rest 21A in the direction of arrow E to pivot member 20A and intermediate section 23A in the direction of arrow F to disengage the locking rib on section 23A from the ejection port, and pulls the gun upwardly out of the holster. Once finger rest 21A is displaced in the direction of arrow E, and the locking rib on section 23A is disengaged from the ejection port of the gun, pulling the gun only a short distance out of the holster is sufficient to release finger rest 21A and allow the spring loaded pin 22A to displace section 23A in the direction opposite of arrow F so that the locking rib on section 23A contacts and slides over the outer surface of the gun barrel while the barrel is removed from the holster. Since at this point the locking rib is only contacting the outer surface of the gun barrel, and is no longer seated in ejection port, the gun barrel simply slides over the locking rib as the gun continues to be withdrawn from the holster.

A further embodiment of the invention is illustrated in FIG. 6. Panel member 20B in FIG. 6 has a construction similar to that of panel member 20, except that (1) member 20B pivots about or with a spring loaded pin 22B mounted in at least one side 50B of the holster and (2) member 20B is connected to intermediate spine section 23B by a pin 22C that slides up and down in a slot 34 formed in spine section 23B. Member 20B functions to slide intermediate spine section 23B out in the direction of arrow G (as indicated by ghost outline 23BB in FIG. 6), and then back in a direction opposite that of arrow G. Spring loaded pin 22B generates forces that function to maintain member 20B and section 23B in the position illustrated in FIG. 6.

The holster in FIG. 6 includes right side 50B and left side 51B (not visible) connected to a spine that includes a fixed upper section 12E, fixed lower section 12D, and displaceable intermediate section 23B. In FIG. 6, sections 12E, 12D, and 23B are aligned with one another. Sides 50B and 51B are connected at the rear 10B of the holster and collectively form a pocket that receives the barrel of a gun (not shown) in a manner similar to that illustrated in FIG. 1.

The intermediate section 23B of the spine is formed to slide out (in the direction of arrow G) and in (in a direction opposite that of arrow G).

Intermediate spine section 23B includes wings 24B and 240B (not visible) connected to the upper 25B and lower 250B (not visible) portions of rib 26B.

Unitary panel member 20B is, as noted, connected to intermediate spine section 23B by pin 22C that slides in slot 34 of section 23B, and, in a manner similar to that of panel member 20, includes front edge 32B, rear edge 27B, and U-shaped finger rest 21B located on the upper end of member 20B. Finger rest 21B extends over the upper edge of a substantially rigid holster flap that is similar to holster flap 33 (FIG. 4) that extends upwardly from portion 12E of the holster spine.

A locking rib (not visible) similar to rib 30 is connected to and extends outwardly from the underside of wing 24B. When intermediate section 23A is in the closed position illustrated in FIG. 6, the locking rib extends into the ejection port of a gun (not shown) and prevents the gun from being withdrawn from the holster. The locking rib functions in the same manner earlier described with respect to rib 30.

In operation of the embodiment of the invention illustrated in FIG. 6, a user grasps the handle of a gun and inserts the gun barrel into the holster to a position similar to that illustrated in FIG. 1. When the gun barrel is slid into the pocket formed by sides 50B and 51B, the outer surface of the barrel contacts and displaces and causes the locking rib on intermediate section 23B, displaces and causes section 23, and displaces and causes panel member 20B to pivot outwardly in the direction of arrow G such that pin 22C slides upwardly in slot 23 of wing 24B and member 20B pivots in the direction of arrow H about or with pin 22B. The outer surface of the barrel slides over and continues to displace the locking rib until the ejection port of the gun is in alignment and registration with the locking rib. When the ejection port is in registration with the locking rib (in the same manner that rib 30 and port 43 are in registration in FIG. 1), spring loaded pin 22B causes section 23B and member 20B to pivot about pin 22B such that section 23B is displaced in a direction opposite that of arrow G and member 20B is simultaneously displaced in a direction opposite that of arrow H, which causes the locking rib to seat in the ejection port. Once the locking rib seats in the ejection port, the gun can not be withdrawn from the holster until the user grasps the handle of the gun, displaces finger rest 21B in the direction of arrow H to pivot member 20B in the direction of arrow H and move intermediate section 23B in the direction of arrow G to disengage the locking rib on section 23B from the ejection port, and pulls the gun upwardly out of the holster. Once finger rest 21 B is displaced in the direction of arrow H, and the locking rib on section 23B is disengaged from the ejection port of the gun, pulling the gun only a short distance out of the holster is sufficient to permit release of finger rest 21A to allow the spring loaded pin 22B to displace pivotally member 20B in a direction opposite that of arrow H and to displace section 23A in a direction opposite of arrow G so that the locking rib on section 23B contacts and slides over the outer surface of the gun barrel while the barrel is removed from the holster. Since at this point the locking rib is only contacting the outer surface of the gun barrel, and is no longer seated in ejection port, the gun barrel simply slides over the locking rib as the gun continues to be withdrawn from the holster.

Still another embodiment of the invention is illustrated in FIG. 7. Panel member 20C in FIG. 7 has a construction similar to that of panel member 20B, except the pivot pin 22E that connects member 20C to intermediate spine section 23C is used to lift (in the manner indicated by ghost outline 23CC in FIG. 7), instead of laterally displace, the upper spine section 23C. Spring loaded pivot pin 22D connects member 20C to at least one side 50C of the holster and generates forces that function to maintain member 20C and section 23C in the position illustrated in FIG. 7. The holster in FIG. 6 includes right side 50C and left side 51C (not visible) connected to a spine that includes a fixed lower section 12F, and displaceable upper section 23C. In FIG. 7, sections 12F and 23C are aligned with one another. Sides 50C and 51 C are connected at the rear 10C of the holster and collectively form a pocket that receives the barrel of a gun (not shown) in a manner similar to that illustrated in FIG. 1.

Upper spine section 23C includes wings 24C and 240C (not visible) connected to the upper 25C and lower 250C (not visible) portions of rib 26C.

Panel member 20C is connected to upper spine section 23C by arm 35 and pin 22E and, in a manner similar to that of panel member 20, includes front edge 32C, rear edge 27C, and U-shaped finger rest 21C located on the upper end of member 20C. Finger rest 21C extends over the upper edge of a substantially rigid holster flap that is similar to holster flap 33 (FIG. 4) that extends upwardly from the top of the holster.

A locking rib (not visible) similar to rib 30 is connected to and extends outwardly from the underside of wing 24C. When upper section 23C is in the closed position illustrated in FIG. 7, the locking rib extends into the ejection port of a gun (not shown) and prevents the gun from being withdrawn from the holster. The locking rib functions in the same manner earlier described with respect to rib 30.

In operation of the embodiment of the invention illustrated in FIG. 7, a user grasps the handle of a gun and inserts the gun barrel into the holster to a position similar to that illustrated in FIG. 1. When the gun barrel is slid into the pocket formed by sides 50C and 51C, the outer surface of the barrel contacts the locking rib on upper section 23C and displaces section 23C in the direction of arrow L which causes finger rest 21C to be displaced in the direction of arrow K. The outer surface of the barrel slides over and continues to displace the locking rib until the ejection port (or other detent) of the gun is in alignment and registration with the locking rib. When the ejection port 43 is in registration with the locking rib (in the same manner that rib 30 and port 43 are in registration in FIG. 1), spring loaded pin 22D causes section 23C and member 20C to pivot about pin 22D such that section 23C is displaced in a direction opposite that of arrow L and member 20C is simultaneously displaced in a direction opposite that of arrow K, which causes the locking rib to seat in the ejection port. Once the locking rib seats in the ejection port, the gun can not be withdrawn from the holster until the user grasps the handle for the gun, displaces finger rest 21C in the direction of arrow K to pivot member 20C about pin 22D and displace upper section 23C in the direction of arrow L to disengage the locking rib on section 23C from the ejection port, and pulls the gun upwardly out of the holster. Once finger rest 21C is displaced in the direction of arrow K, and the locking rib on section 23C is disengaged from the ejection port of the gun, pulling the gun only a short distance out of the holster is sufficient to permit release of finger rest 21C and allow the spring loaded pin 22D to displace section 23C in the direction opposite of arrow L so that the locking rib on section 23C contacts and slides over the outer surface of the gun barrel while the barrel is removed from the holster. Since at this point the locking rib is only contacting the outer surface of the gun barrel, and is no longer seated in ejection port, the gun barrel simply slides over the locking rib as the gun continues to be withdrawn from the holster. In another embodiment of the invention, a spring loaded pin 22D is not utilized, and the member 20C is simply manually operated.

One particular unexpected and unpredicted benefit discovered after the invention was developed is that the holster spine can be segmented to facilitate engaging the ejection port of a gun. This is not an idea that I initially pursued and did not seem to make sense, just as the idea of segmenting an individual's spine does not make sense because it would weaken and paralyze the individual.

Another unexpected and unpredicted benefit discovered after the invention was developed is that the locking rib 30 can be moved outwardly in a direction toward the front of the holster spine. Common sense suggested that the locking rib 30 should be moved laterally, to the side of the gun barrel. The idea of moving rib 30 toward the front of the spine was not initially pursued. The idea that the rib 30 had to be moved laterally would have made incorporating movement of the holster spine difficult, if possible at all, because laterally moving a section of the holster spine would have been difficult because the gun barrel would have impeded such movement.

A further unanticipated benefit discovered after the invention was developed is that it facilitates removal of a gun from a holster because the thumb rest can be easily engaged and displaced rearwardly in the direction of arrow A after an individual grasps the handle 41 of gun 40.

As used herein, relying on common sense judgment requires that valid reasoning justifying such judgment be set forth.

A strong long felt trend exists, when a holster locking mechanism is displaced from the ejection port, to displace a holster locking mechanism at least in part in a direction laterally away from the ejection port. This trend has occurred over an extended period of time, is followed by a large number of individuals in the pertinent art, and likely can be demonstrated by a significant number of references. A countervailing trend, if any, not to displace a holster locking mechanism in a direction laterally away from the ejection port is believed to be much weaker or to be obfuscated among other trends in the art.

A strong long felt trend also exists to utilize a locking mechanism in holsters that have unitary spines. This trend has occurred over an extended period of time, is followed by a large number of individuals in the pertinent art, and likely can be demonstrated by a significant number of references. A countervailing trend, if any, to segment the holster spine so a portion of the spine is movable with respect to the remainder of the spine is believed to be much weaker or to be obfuscated among other trends in the art.

There appears to be no problem identified in the prior art that provides a significant impetus or motivation to produce the invention.

There appears to be no problem identified in the prior art that suggests a specific solution set, one of which solutions comprises the invention.

The TSM test, which can provide helpful insight into the obviousness of the invention, does not appear to suggest the invention.

There does not appear to be a mechanical device that can be substituted into a conventional holster to produce the invention. And, if there is such a device, it is believed that it is unlikely one of ordinary skill would have considered such a device and to substitute the equivalent, that there is no trend in the art that provides significant impetus to make such a substitution, the there is no problem in the art that provides significant impetus to make such a substitution, and/or that the value of making such a substitution has long been overlooked by others and was only recognized by the inventor. There evidently existed at the time of the invention no motivation to utilize a section of the spine to interlock with the ejection port of a gun or be operated by a user's hand, or to substitute a segmented spine for a unitary spine in a holster. Substituting a movable spine portion in a fixed spine is not substituting an equivalent because the idea of a movable spine portion is squarely opposed to the idea of a unitary spine, and because the unitary spine has to be modified to incorporate the movable spine portion. Further, if the equivalent that is being substituted is found in non-analogous art this likely reduces the likelihood the equivalent would be found, recognized, and utilized, which normally produces a significantly weaker obviousness case unless reasons can be provided supporting the proposition that such a substitution would be made. Providing such reasons is important because most inventions are combinations of known off-the-shelf components and equivalents can almost always be found. Simply stating that it would be known by one of skill in the art to substitute an equivalent is not, without providing good reasons, believed sufficient. Otherwise such a generalized rationale could be used to invalidate most, if not all, patents known to man.

Having described my invention in such terms as to enable those of skill in the art to understand and use it, and having described the presently preferred embodiments and best mode thereof, I claim:

1. In combination with a gun including a handle, barrel, and an ejection port, a holster including (a) a spine;

(b) a first side;

(c) a second side opposed to said first side, said first and second sides (i) collectively forming a pocket with a front, a top, and a rear and receiving the barrel with the handle extending outside said top of said pocket, (ii) connected together along said rear of said pocket, (iii) connected to said spine at said front of said pocket, said spine including (iv) a fixed upper section (12A), (v) a fixed lower section (12), (vi) an intermediate section (23) bridging said upper section and said lower section, pivotally attached to said upper section, including a pair of opposed, spaced apart wings (24, 240), and including a locking rib (30) attached to one of said wings and extending toward the other of said wings, (vii) a vertically oriented leading edge outside said pocket, said upper section, said lower section and said intermediate section each including a portion of said leading edge, said intermediate section movable between (viii), a first operative position generally in alignment with said upper section and said lower section in which said locking rib extends from said one of said wings into the ejection port to prevent the gun from being withdrawn from the holster, and (ix) a second operative position in which said intermediate section is pivoted about said upper section, is moved away from said lower section, and is moved out of alignment with said upper and lower sections and said locking rib is moved free of the ejection port to permit the gun to be withdrawn from the holster; and (d) a finger rest (i) connected to said intermediate section to manually pivotally displace with the finger of a hand, while grasping the handle of the gun with said hand, said intermediate section from said first operative position to said second operative position to permit the gun to be withdrawn from the holster; and, (ii) extending outwardly away from said top of said pocket.

* * * * *